US006783482B2

(12) United States Patent
Oglesby et al.

(10) Patent No.: US 6,783,482 B2
(45) Date of Patent: Aug. 31, 2004

(54) TREADMILL CONTROL SYSTEM

(75) Inventors: Gary E. Oglesby, Manhattan, IL (US); Emil S. Golen, Jr., Barrington, IL (US); James B. Fox, Elk Grove Village, IL (US); John Danile, Algonquin, IL (US); Robert D. Kohan, Naperville, IL (US); Christopher E. Clawson, Palatine, IL (US); Kenneth F. Lantz, Poquoson, VA (US); Daniel R. Wille, St. Louis Park, MN (US); Timothy J. Porth, Bloomington, MN (US)

(73) Assignee: Brunswick Corporation, Lake Forest, IL (US)

( * ) Notice: Subject to any disclaimer, the term of this patent is extended or adjusted under 35 U.S.C. 154(b) by 310 days.

(21) Appl. No.: 09/944,142

(22) Filed: Sep. 4, 2001

(65) Prior Publication Data

US 2002/0045517 A1 Apr. 18, 2002

Related U.S. Application Data

(63) Continuation-in-part of application No. 09/651,249, filed on Aug. 30, 2000, now Pat. No. 6,626,803.

(60) Provisional application No. 60/230,733, filed on Sep. 7, 2000.

(51) Int. Cl.[7] ..... A63B 22/00

(52) U.S. Cl. ..... 482/54; 482/51

(58) Field of Search ..... 482/51, 54

(56) References Cited

U.S. PATENT DOCUMENTS

| | | | | | |
|---|---|---|---|---|---|
| 4,911,427 | A | * | 3/1990 | Matsumoto et al. | 482/9 |
| 5,314,391 | A | * | 5/1994 | Potash et al. | 482/7 |
| 5,368,532 | A | * | 11/1994 | Farnet | 482/54 |
| 5,820,525 | A | * | 10/1998 | Riley | 482/54 |
| 6,575,878 | B1 | * | 6/2003 | Choy | 482/54 |

* cited by examiner

*Primary Examiner*—Glenn E. Richman
(74) *Attorney, Agent, or Firm*—Michael B. McMurry

(57) ABSTRACT

A microprocessor based exercise treadmill control system is disclosed which includes various features to enhance user operation. These features include programs operative to: permit a set of user controls to cause the treadmill to initially operate at predetermined speeds; permit the user to design custom workouts; permit the user to switch between workout programs while the treadmill is in operation; and perform an automatic cooldown program where the duration of the cooldown is a function of the duration of the workout or the user's heart rate. The features also include a stop program responsive to a detector for automatically stopping the treadmill when a user is no longer on the treadmill and a frame tag module attached to the treadmill frame having a non-volatile memory for storing treadmill configuration, and operational and maintenance data. Another included feature is the ability to display the amount of time a user spends in a heart rate zone.

10 Claims, 16 Drawing Sheets

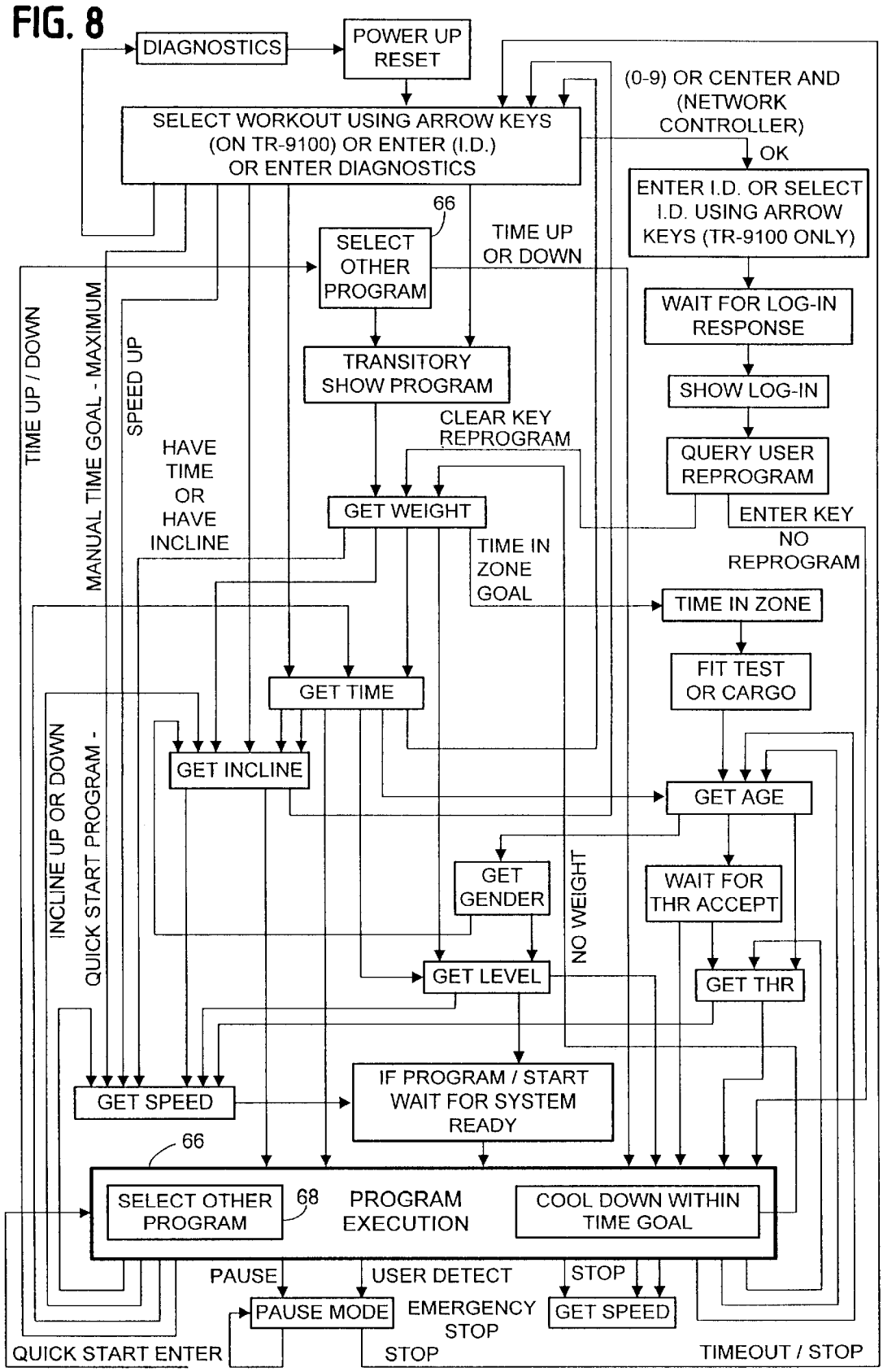
FIG. 8
DIAGNOSTICS
POWER UP RESET
SELECT WORKOUT USING ARROW KEYS (ON TR-9100) OR ENTER (I.D.) OR ENTER DIAGNOSTICS
(0-9) OR CENTER AND (NETWORK CONTROLLER)
OK
ENTER I.D. OR SELECT I.D. USING ARROW KEYS (TR-9100 ONLY)
66
SELECT OTHER PROGRAM
TIME UP OR DOWN
WAIT FOR LOG-IN RESPONSE
TRANSITORY SHOW PROGRAM
SHOW LOG-IN
CLEAR KEY REPROGRAM
QUERY USER REPROGRAM
TIME UP / DOWN
MANUAL TIME GOAL - MAXIMUM
SPEED UP
HAVE TIME OR HAVE INCLINE
GET WEIGHT
ENTER KEY NO REPROGRAM
TIME IN ZONE GOAL
TIME IN ZONE
FIT TEST OR CARGO
GET TIME
INCLINE UP OR DOWN
QUICK START PROGRAM -
GET INCLINE
GET AGE
GET GENDER
NO WEIGHT
WAIT FOR THR ACCEPT
GET LEVEL
GET THR
GET SPEED
IF PROGRAM / START WAIT FOR SYSTEM READY
66
SELECT OTHER PROGRAM
68
PROGRAM EXECUTION
COOL DOWN WITHIN TIME GOAL
PAUSE
USER DETECT
STOP
PAUSE MODE
EMERGENCY STOP
GET SPEED
QUICK START ENTER
STOP
TIMEOUT / STOP

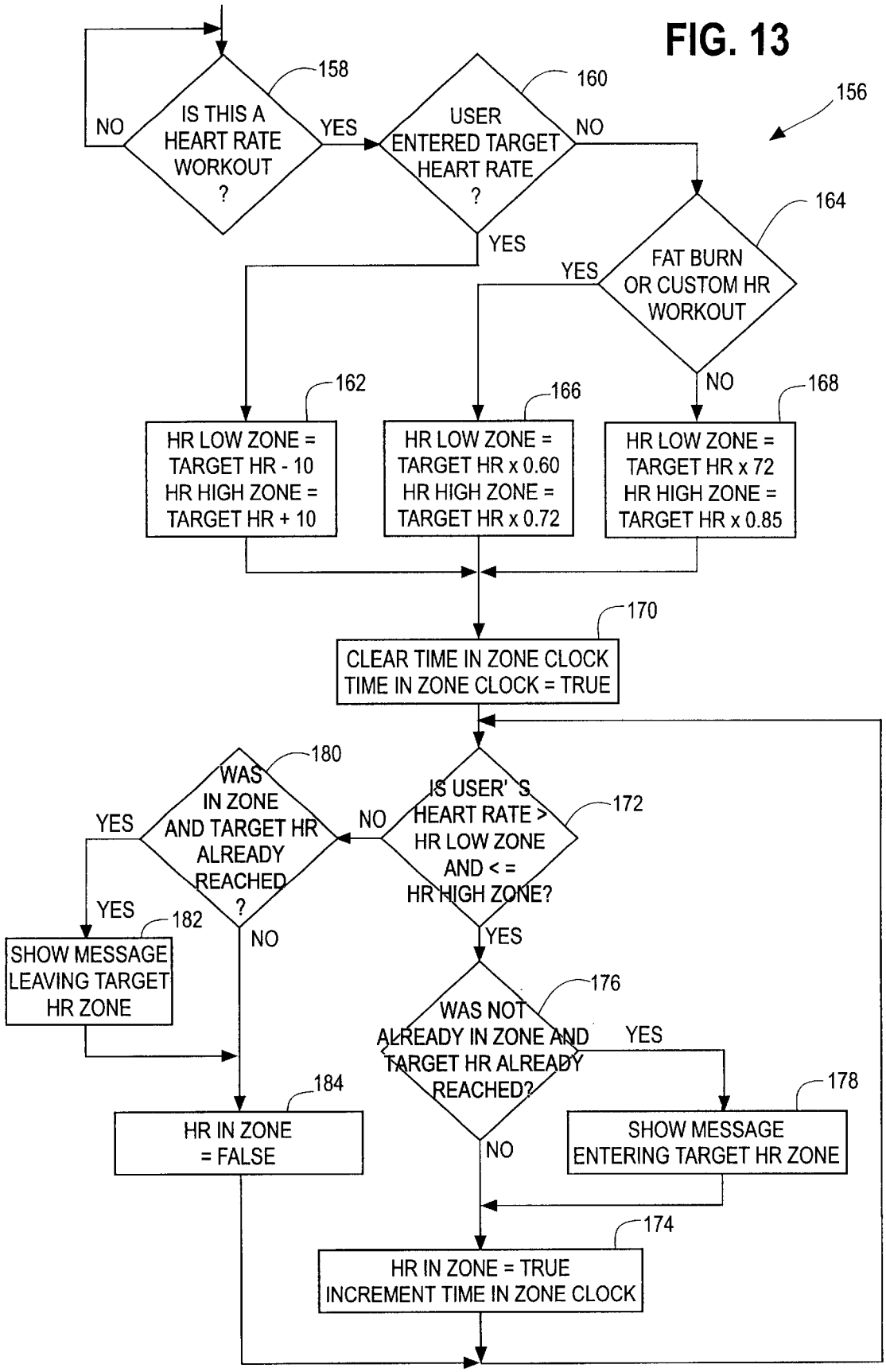
FIG. 13
156
158
IS THIS A HEART RATE WORKOUT ?
NO
YES
160
USER ENTERED TARGET HEART RATE ?
NO
YES
164
FAT BURN OR CUSTOM HR WORKOUT
YES
NO
162
HR LOW ZONE = TARGET HR - 10
HR HIGH ZONE = TARGET HR + 10
166
HR LOW ZONE = TARGET HR x 0.60
HR HIGH ZONE = TARGET HR x 0.72
168
HR LOW ZONE = TARGET HR x 72
HR HIGH ZONE = TARGET HR x 0.85
170
CLEAR TIME IN ZONE CLOCK
TIME IN ZONE CLOCK = TRUE
172
IS USER' S HEART RATE > HR LOW ZONE AND < = HR HIGH ZONE?
NO
YES
180
WAS IN ZONE AND TARGET HR ALREADY REACHED ?
YES
NO
182
SHOW MESSAGE LEAVING TARGET HR ZONE
176
WAS NOT ALREADY IN ZONE AND TARGET HR ALREADY REACHED?
YES
NO
178
SHOW MESSAGE ENTERING TARGET HR ZONE
184
HR IN ZONE = FALSE
174
HR IN ZONE = TRUE
INCREMENT TIME IN ZONE CLOCK

TREADMILL CONTROL SYSTEM

CROSS-REFERENCE TO RELATED APPLICATIONS

This application is a continuation in part of application Ser. No. 09/651,249, filed Aug. 30, 2000, U.S. Pat. No. 6,626,803, which claims the benefit of Provisional application Ser. No. 60/230,733, filed Sep. 7, 2000.

FIELD OF THE INVENTION

This invention generally relates to exercise equipment and in particular to exercise treadmills having control systems utilizing microprocessors.

BACKGROUND OF THE INVENTION

Exercise treadmills are widely used for performing walking or running aerobic-type exercise while the user remains in a relatively stationary position. In addition exercise treadmills are used for diagnostic and therapeutic purposes. Generally, for all of these purposes, the person on the treadmill performs an exercise routine at a relatively steady and continuous level of physical activity. One example of such a treadmill is provided in U.S. Pat. No. 5,752, 897.

Although exercise treadmills that operate using a microprocessor based control system have reached a relatively high state of development, there are a number of significant improvements in the program software that can improve the user's exercise experience.

SUMMARY OF THE INVENTION

It is therefore an object of the invention to provide an exercise treadmill having improved user programs.

A further object of the invention is to provide a treadmill having a control panel that includes a standard set of user controls with a second set of quick start user controls that permits the user to select certain predetermined treadmill operating parameters such as speed to initiate a workout or to change to one of the predetermined speeds during a workout.

Another object of the invention is to provide a treadmill having a control panel that includes user controls that permit the user to program custom user workouts which have certain operating parameters such as speed and inclination where the custom workouts have greater flexibility than the standard workouts normally programed in a treadmill.

An additional object of the invention is to permit the user to switch programs while the treadmill is operating by merely pressing a particular program button without having to stop the treadmill and start a new program.

A further object of the invention is to provide an automatic cooldown feature that automatically begins upon conclusion of the user's workout where the duration of the cooldown is determined by the length of time of the user's workout and where the treadmill includes a heart rate management system, the cooldown can be terminated by the user's heart rate reaching 60% of maximal.

Another object of the invention is to increase the frequency of display information on the user display that is relevant to the manner in which the treadmill is being used and to decrease the frequency of the display information that is not relevant.

A still further object of the invention is to provide a user detect feature that can use a detector such as an IR receiver/transmitter to stop the operation of the treadmill in order to overcome the problem of users leaving treadmills before the end of their programs which can result in treadmills continuing to run for a period of time. This feature can be further enhanced by using treadmill operating criteria such as key pad or motor controller activity to determine if a user is on the treadmill.

Yet an additional object of the invention is to provide a frame tag module secured to the frame of the treadmill and that includes a nonvolatile electrically erasable programmable memory chip and a real time clock.

It is also an object of the invention to provide a treadmill with a quick start feature.

Another object of the invention is to provide a display of the amount of time a user spends in a specified heart rate zone.

BRIEF DESCRIPTION OF THE DRAWINGS

FIG. 8 is a flow chart illustrating the operation of the control system of FIG. 2 to implement a feature whereby the user can select a new workout program while the treadmill of FIG. 1 is operating in another workout program;

FIG. 13 is a flow chart illustrating the operation of a time in heart rate zone feature for use with the treadmill of FIG. 1.

DETAILED DESCRIPTION OF THE INVENTION

Figure 1:
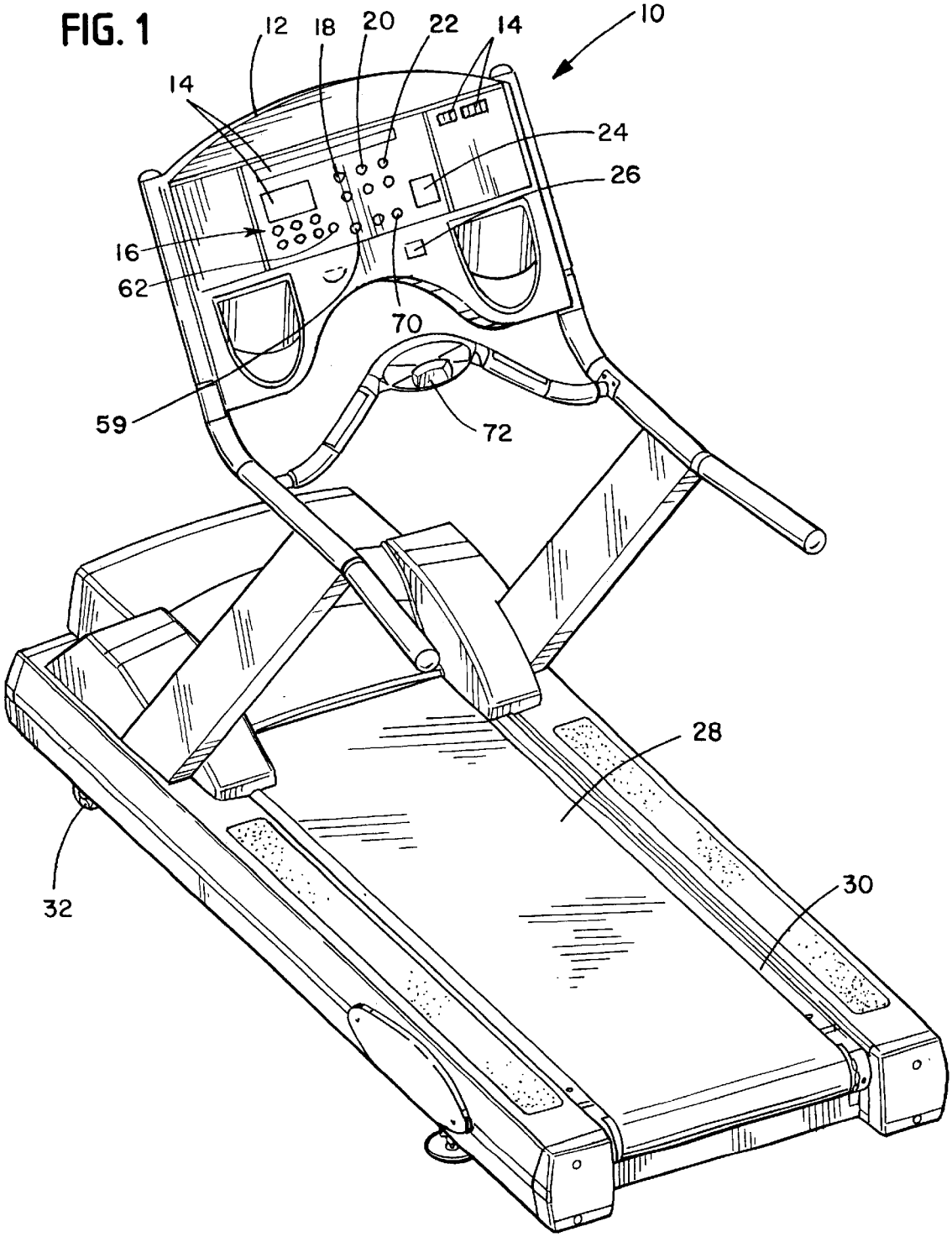
FIG. 1 is a perspective view of an assembled exercise treadmill according to the invention.

FIG. 1 shows the general outer configuration of an exercise treadmill 10, according to the invention. The treadmill includes a control panel 12 having a set of displays 14; a set of workout program control buttons 16; a set of operational controls 18-22 including a pair of time control buttons 18, a pair of incline control buttons 20 and a pair of speed control buttons 22; a numerical keypad 24; and a stop button 26. In addition, the treadmill 10 includes such conventional treadmill elements such as a belt 28, a deck 30 and an inclination mechanism 32 of the type described in U.S. Pat. No. 6,095,951.

Figure 2:
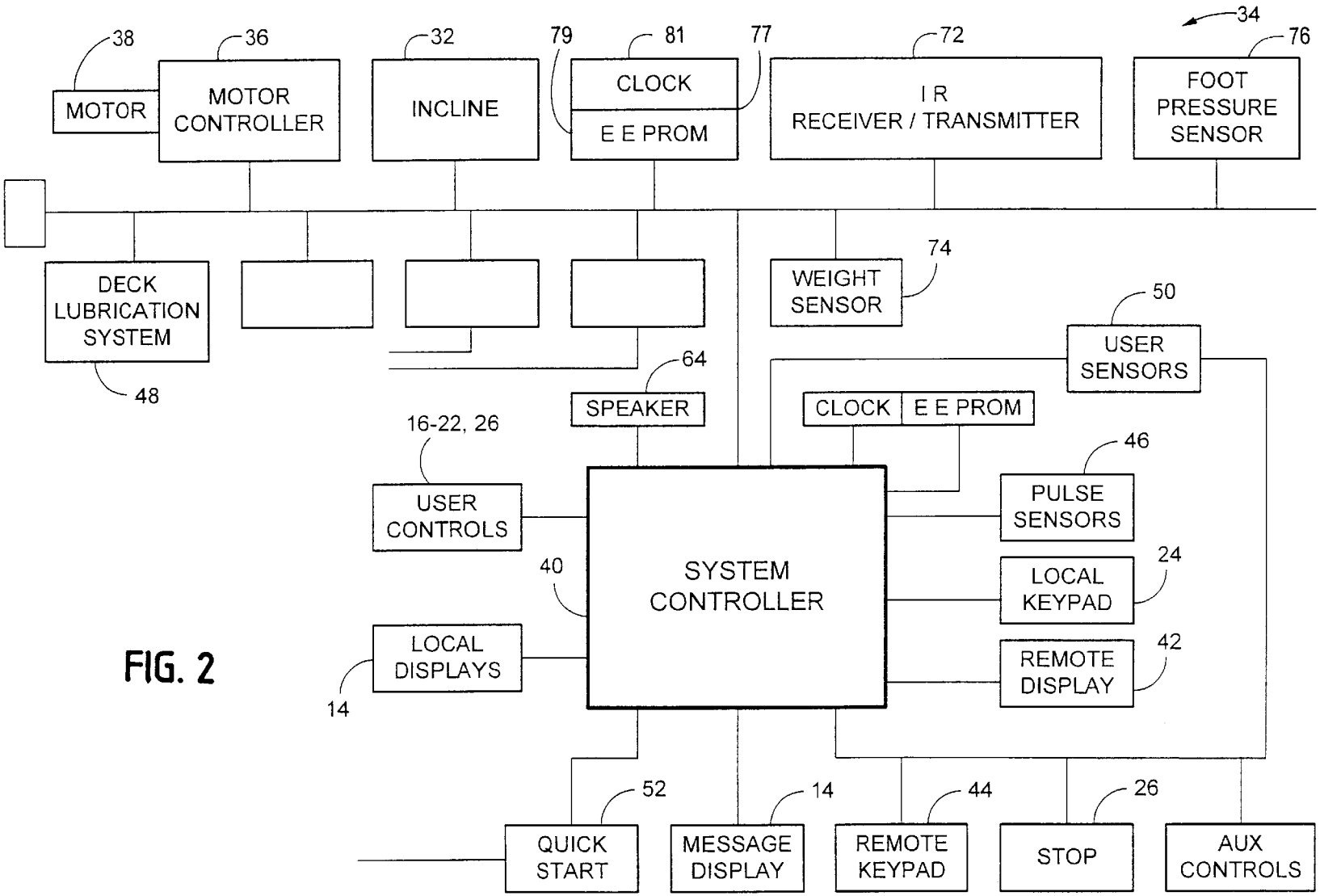
FIG. 2 is a block diagram of the control system for the treadmill of FIG. 1.

FIG. 2 is a representative block diagram of a control system 34 for the treadmill 10. The control system 34 is generally similar to the treadmill control systems of the type shown in FIG. 16 of U.S. Pat. No. 6,095,951 and controls an AC motor 38 having a motor controller 36 to propel the belt 28. The control system 34 uses a microprocessor based system controller 40 to control the control panel displays 14 including a message display 14, the user controls 16–22 and 26 along with the keypad 24, an optional remote display 42 and a remote keypad 44. In addition, the control system 34 serves to control a heart rate monitoring system of the type described in U.S. Pat. No. 5,313,487 utilizing a set of pulse sensors 46 and a deck or belt lubrication system 48 of the type shown in U.S. Pat. No. 5,433,679 along with the inclination mechanism 32. The control system also controls a user detect or sense system 50.

Figure 3:
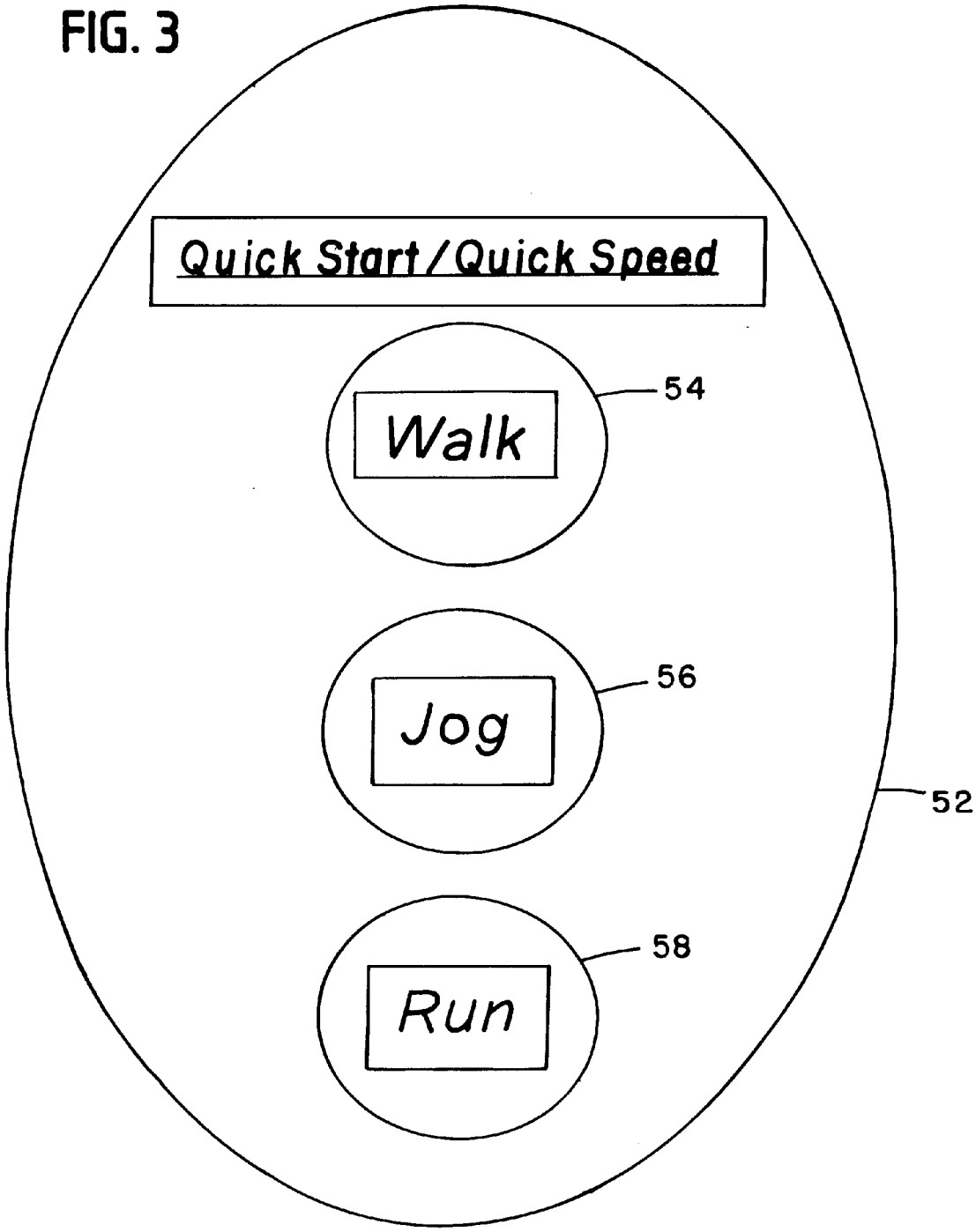
FIG. 3 is a plan view quick start/quick speed control including a set of user switches for a quick start feature for use with the control system of FIG. 1.
Figure 4:
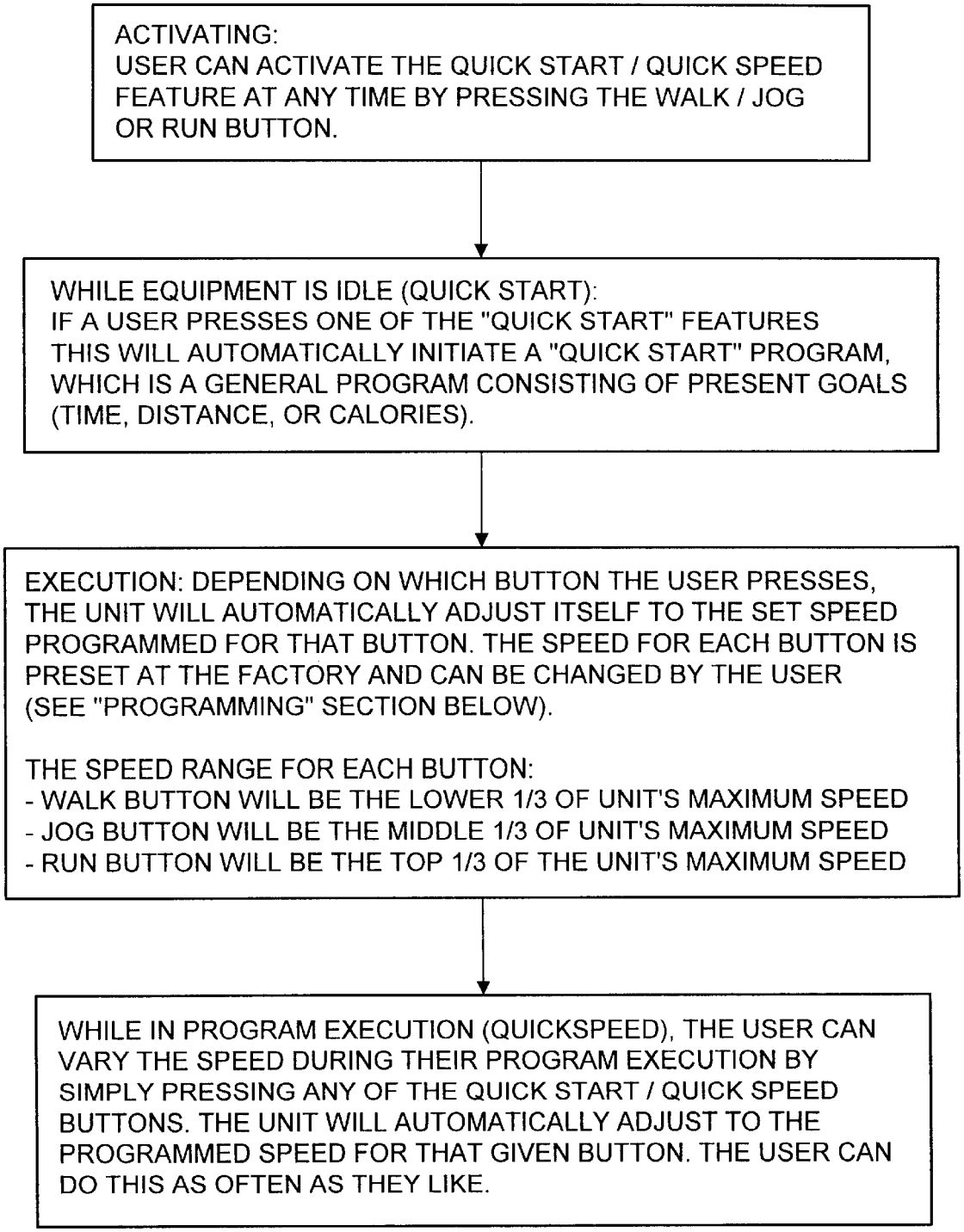
FIGS. 4 and 5 are flow charts illustrating the operation of the quick start/quick speed control of FIG. 3.
Figure 5:
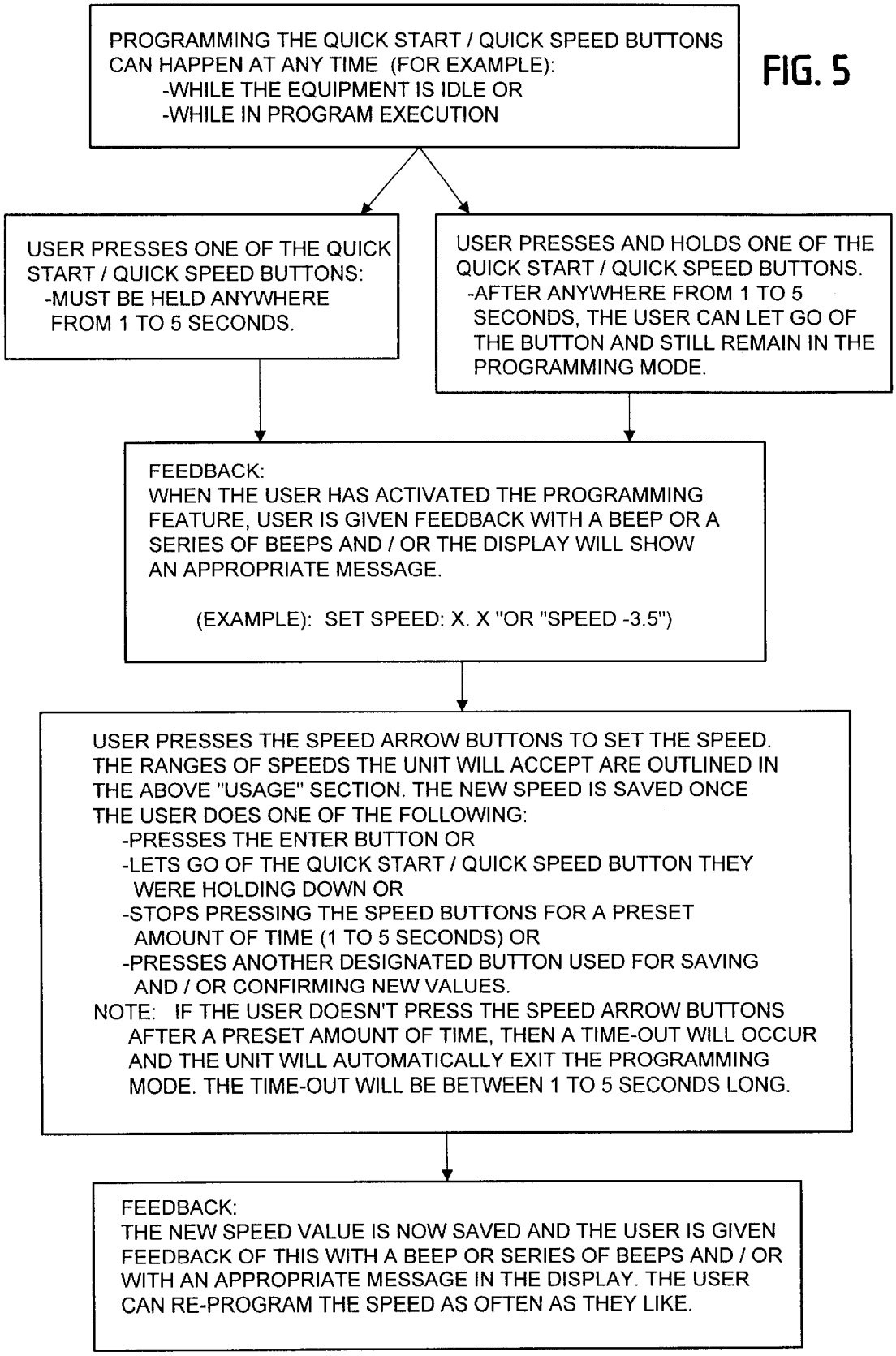

FIGS. 3–5 illustrate a quick start feature that can be implemented in the control system 34. In particular, a quick start keypad 52 can be attached to the control panel 12 or some other part of the treadmill 10. The keypad 52 is provided with a set of three buttons: a walk button 54, a jog button 56 and a run button 58 that can be used by the user to immediately initiate a workout or change a workout having preferably a predetermined speed, for example corresponding to walk, jog or run. The operational controls 18–22 can also be used to set other predetermine workout parameters such as inclination, time, distance or calories. User operation is described in FIG. 4 and operation of the program is described in the flow chart of FIG. 5. Along with a quick start, as indicated in FIGS. 4 and 5, the keypad 52 can be used by the user to immediately implement the predetermined speeds or other workout parameters while another workout is in progress. In addition, it is also possible to use a single quick start button 59 on the control panel 12 in combination with the operational controls 18–22 to initiate the quick start feature.

Figure 6:
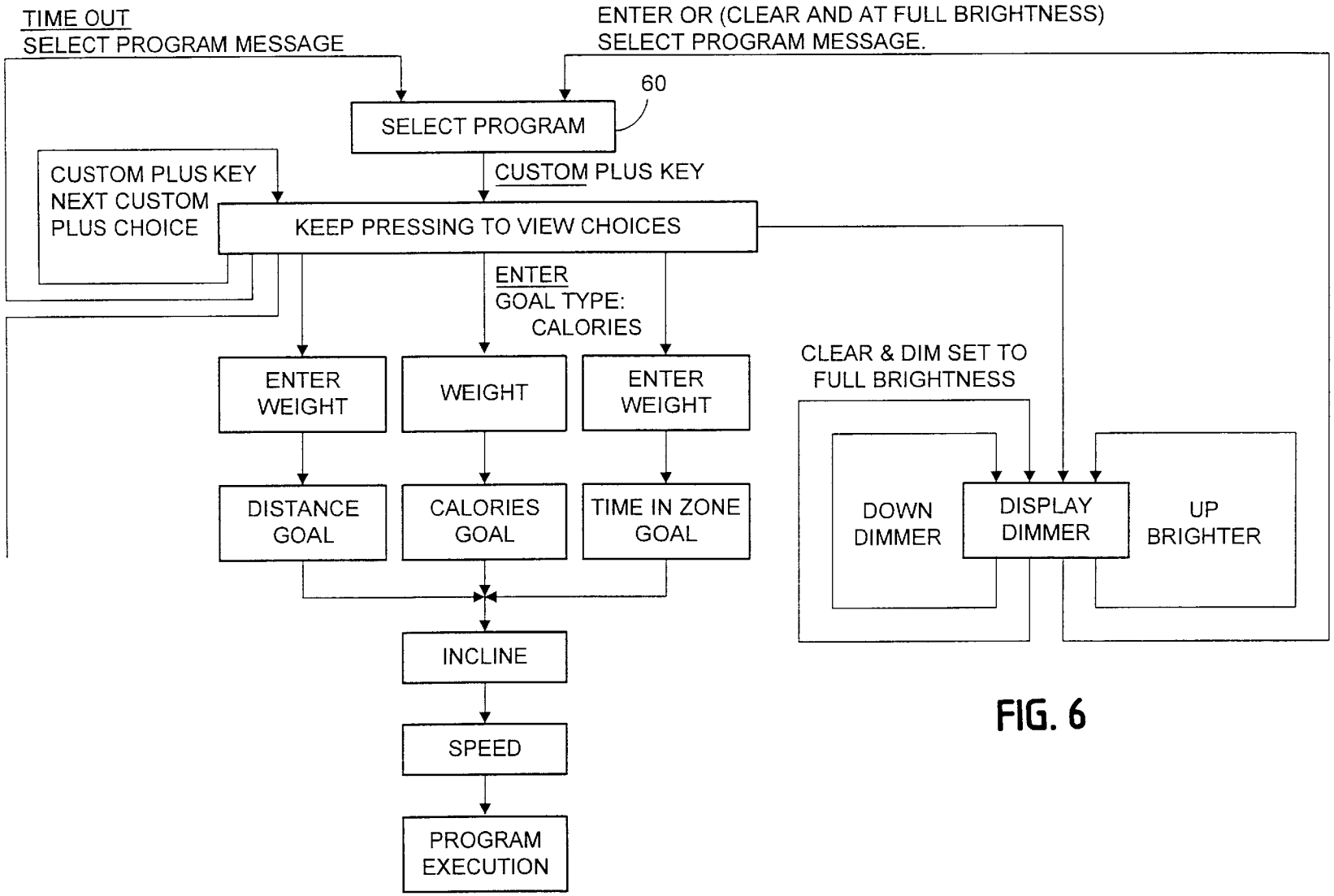
FIGS. 6 and 7 are flow charts illustrating the operation of a custom workout feature for use with the control system of FIG. 2.
Figure 7:
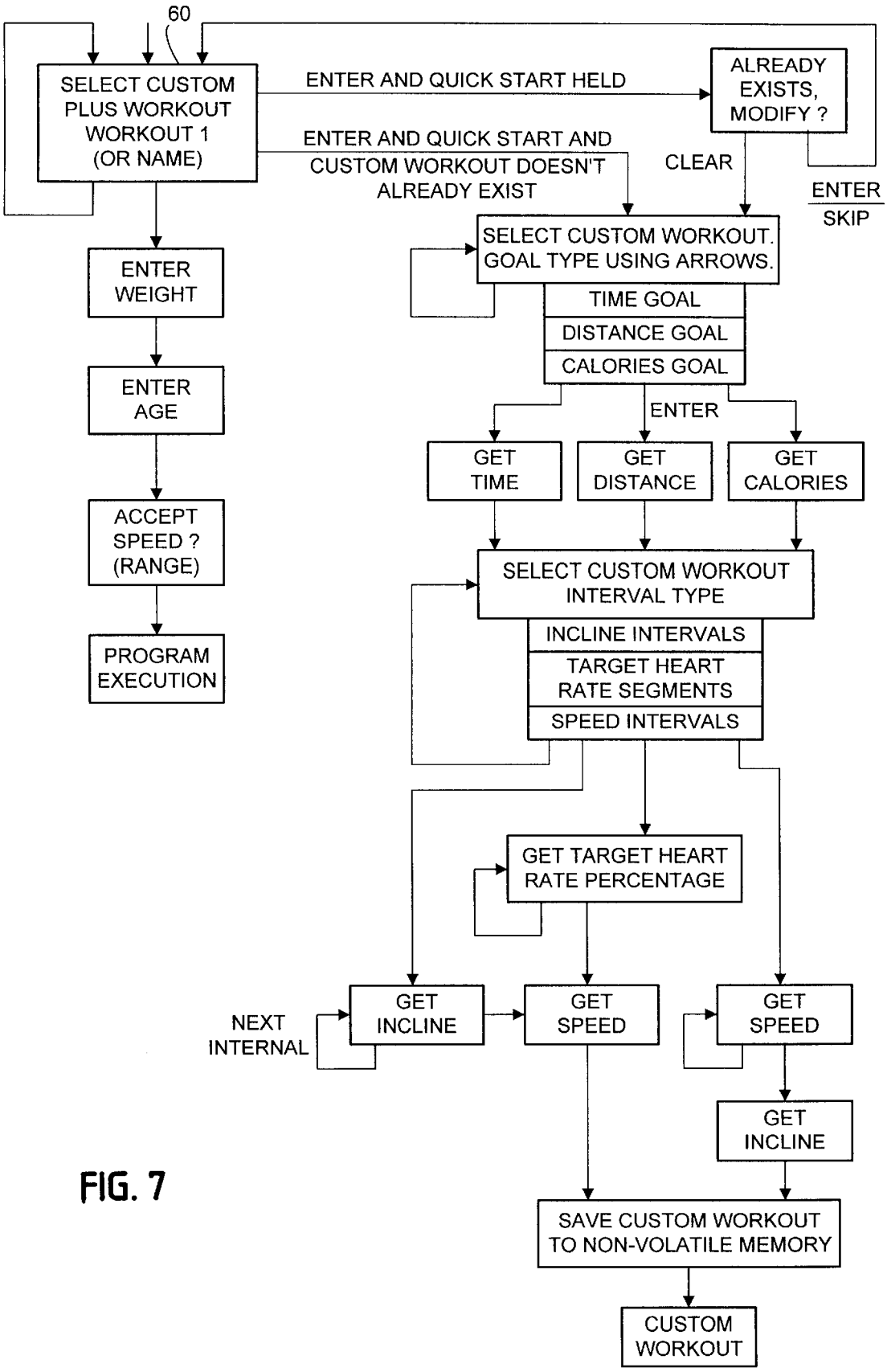

FIGS. 6 and 7 are flow charts describing the logic of a preferred embodiment of a custom workout program that can be implemented in the control system 34. Generally, this feature permits a user or his trainer to use the control keys 18–22, the keypad 24 and the displays 14 to design and program into the control system 34 a custom workout having greater flexibility than the standard workouts normally programed in a treadmill. For example as described in FIGS. 6 and 7, the trainer can define a heart rate workout utilizing the pulse sensors and heart rate management system 46 consisting of a series of segments, up to 30, of a fixed duration in seconds, each segment containing a predetermined target heart rate. As indicated at a block 60 in the flow charts of FIGS. 6 and 7, the user can select the custom program mode by pressing a custom button 62 which is one of the program buttons 16 on the control panel 12. In this case the heart rate management program can be used to control the inclination mechanism 32 of the treadmill 10 thereby regulating the user's heart rate for each interval or segment of the program. Also, custom interval hill workouts can be designed where each segment of the workout represents a different incline of the treadmill 10. Similarly, custom interval speed workouts can be designed by the trainer where each segment of the workout utilizes a different speed. Here, it is desirable to provide the user with an aural warning over a speaker 64 shown in FIG. 2 of speed changes to prevent surprise transitions. Thus, it is possible to provide a wide variety of custom workouts where the user or trainer can define a number of workout parameters such as the initial speed, duration of the workout, distance and calories burned.

FIG. 8 is a flow chart illustrating the operation of the control system 34 to execute workout programs where, as indicated a pair of blocks 66 and 68, the control system 34 also permits the user to switch workout programs on the fly by merely pressing one of the program buttons 16 without having to stop the treadmill 10 and start a new workout program. Specifically, the user can select a new workout program having different parameters including, for example, speed, incline, intervals and heart rate while in the midst of a first workout program.

Figure 9:
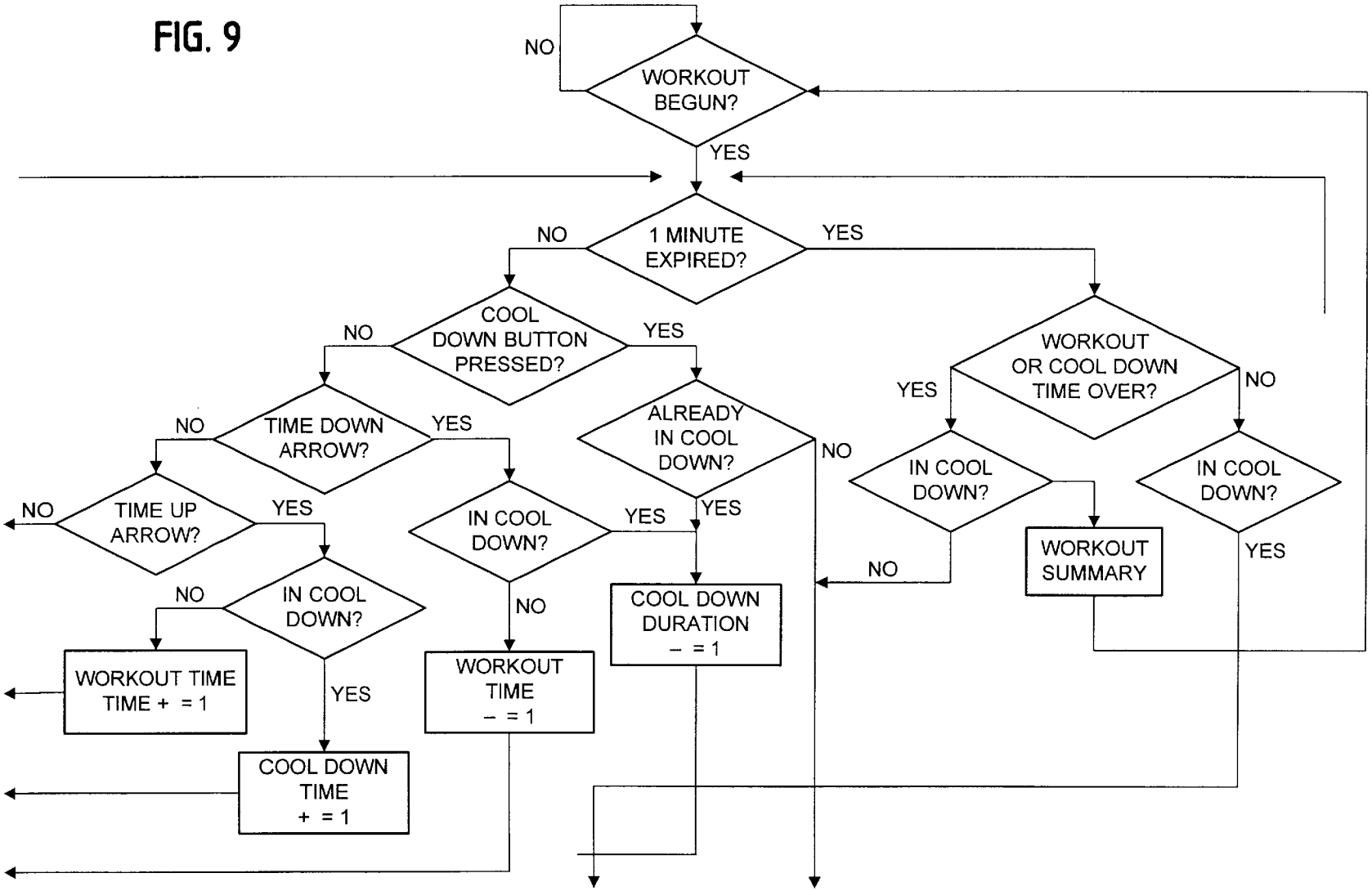
FIGS. 9 and 10A–B are flow charts illustrating the operation of an automatic cooldown feature for use with the control system of FIG. 2.
Figure 10A:
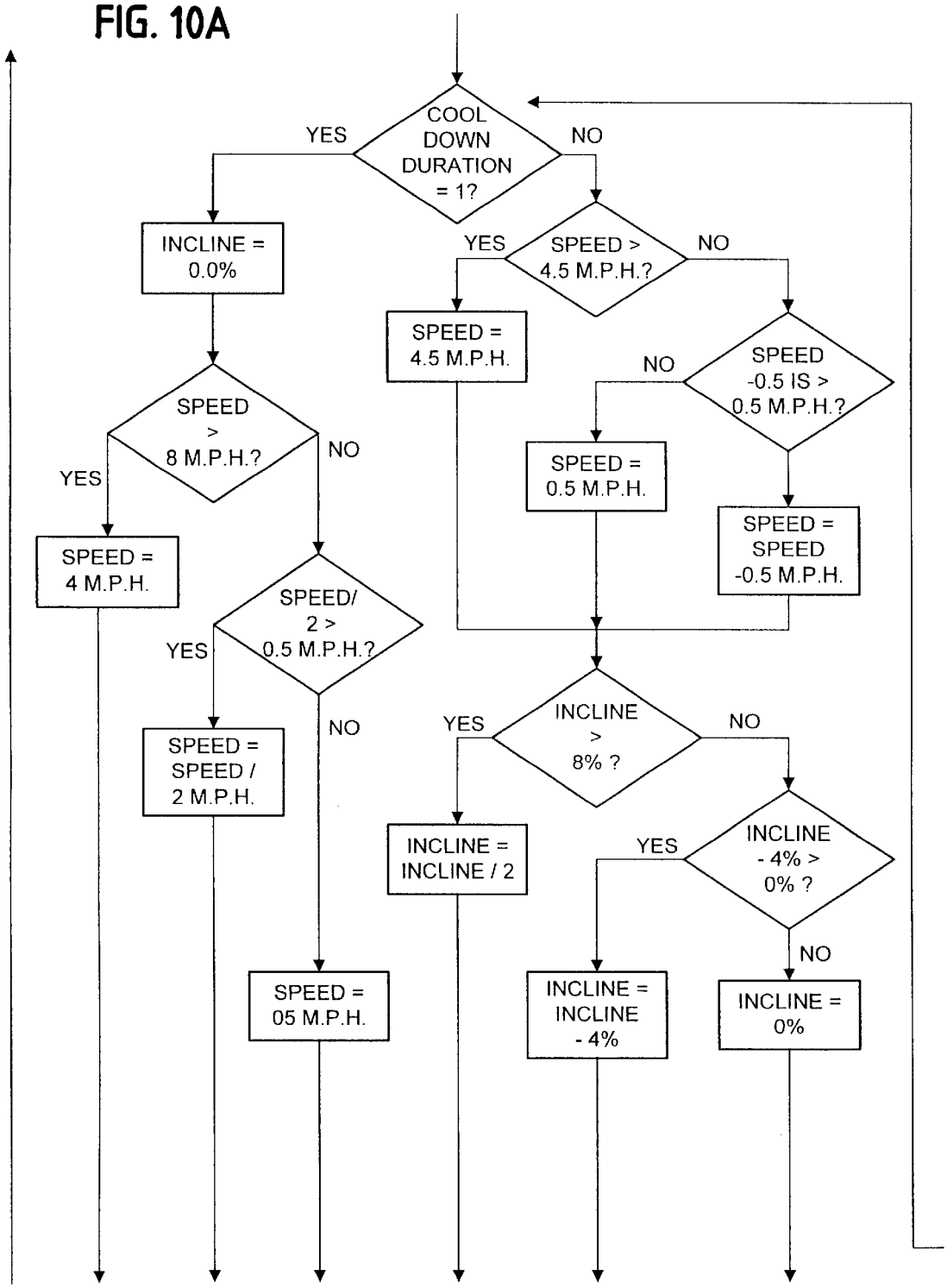
Figure 10B:
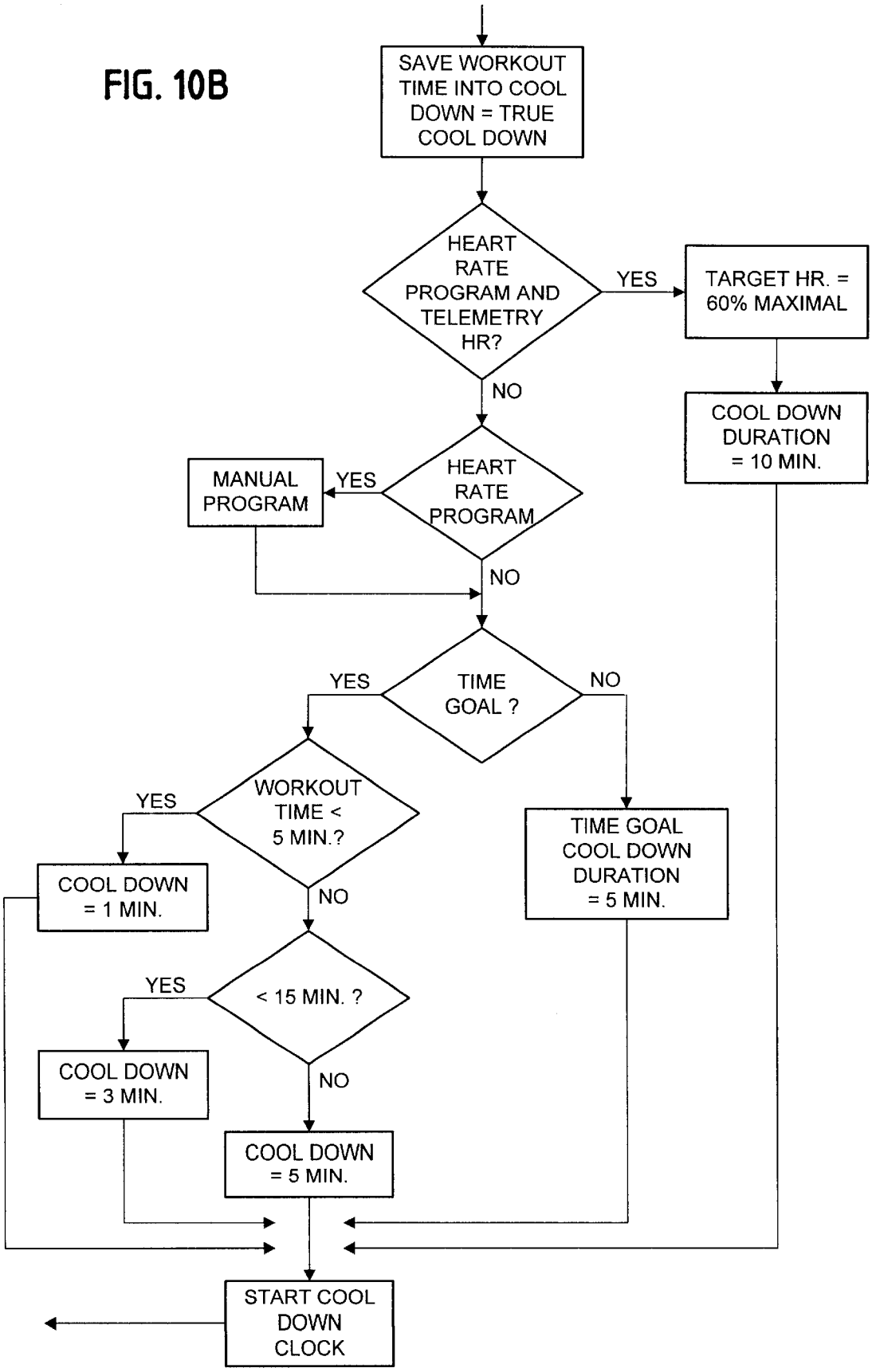

FIGS. 9 and 10A–B show in flow chart form the logic of an automatic cooldown feature that can be implemented in the control system 34. In the protocol described in FIGS. 9 and 10A–B, cooldown will begin automatically upon conclusion of the user's workout. Here, the duration of the cooldown is determined by the length of time of the user's workout or can also be terminated by the user's heart rate reaching 60% of maximal if a heart rate management program of the type identified above is being used. In addition, cooldown can be initiated by the user at any time by pressing a cooldown button 70 located on the control panel 12. In the system described in FIGS. 9 and 10A–B, the cooldown sequence will normally automatically progress each minute except that the user can advance the cooldown by pressing the cooldown button 70 or extend the cooldown by using arrow keys on the keypad 24.

Another feature of the treadmill 10 is the provision in the system controller 34 to only display information on the user displays 14 that is relevant to the manner in which the treadmill 10 is being used. Because the number of discrete displays on the user displays 14 is limited and non-relevant information can be annoying to a user, it is desirable to provide only that information to the user that is most useful for the particular workout that he is performing at the moment. For example, the treadmill 10 having its incline mechanism 32 set at something other than zero will accumulate and can display on one the displays 14 the total vertical distance the user has climbed during the workout. However, if the treadmill 10 is set at zero inclination, the user might become annoyed with a message on the displays 14 always having a zero reading. Thus, in the preferred embodiment of the invention the system controller 40 of the control system of 34 will be programed to only generate a total climb figure on one of the displays 14 at periodic intervals such as 5 minutes. By the same token, generally only runners are interested in their pace such as minutes per mile, so this information will not be displayed by the system controller 40 on the displays 14 for walkers. Also, calories per hour, watts and mets will only be displayed on one of the displays 14 upon a workload change such as a significant speed or incline change so as to eliminate the same message from being displayed on the displays 14 over and over.

Figure 11:
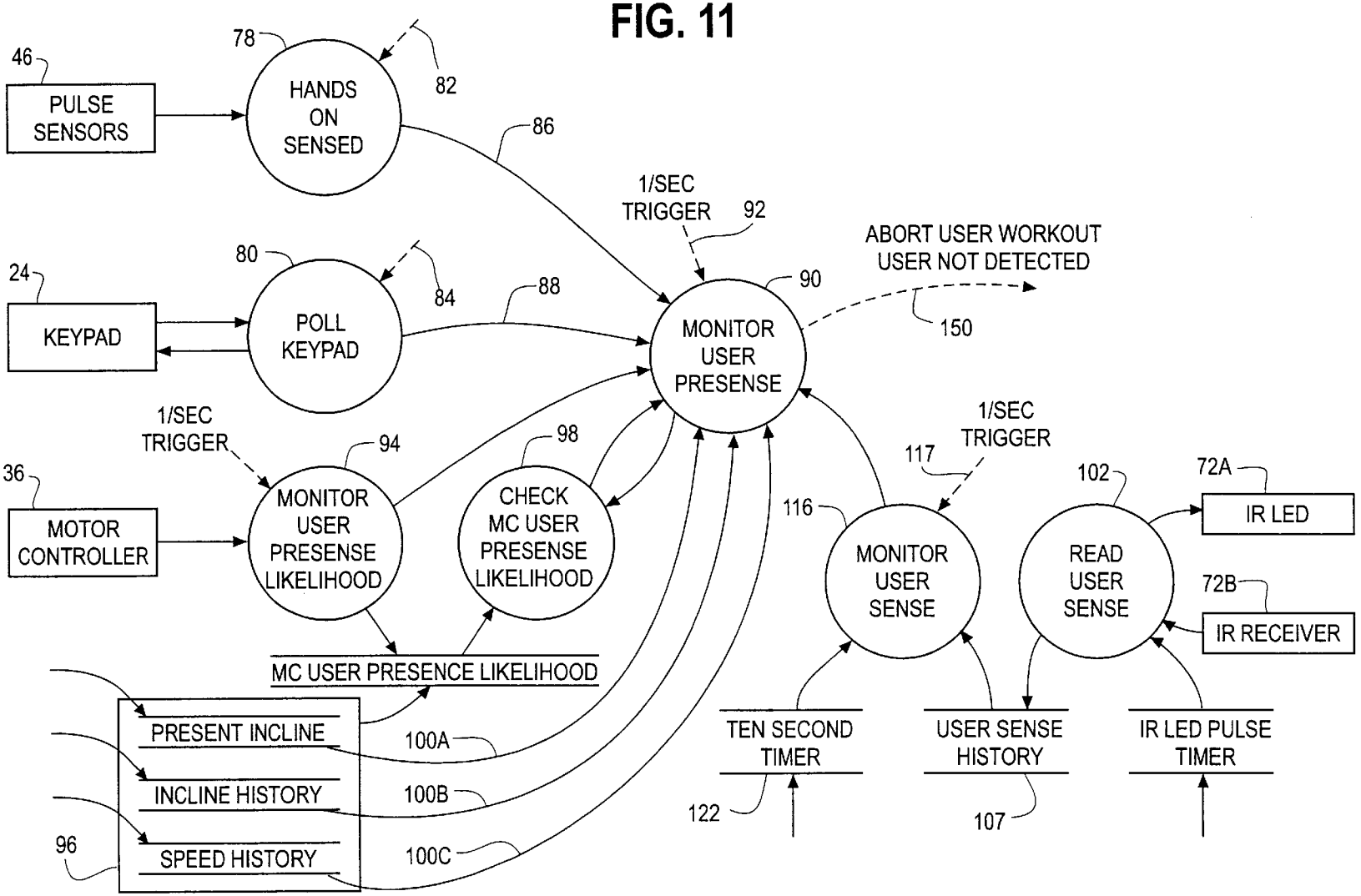
FIG. 11 is a data flow diagram for a user detect feature for use with the treadmill of FIGS. 1 and 2.
Figure 12A:
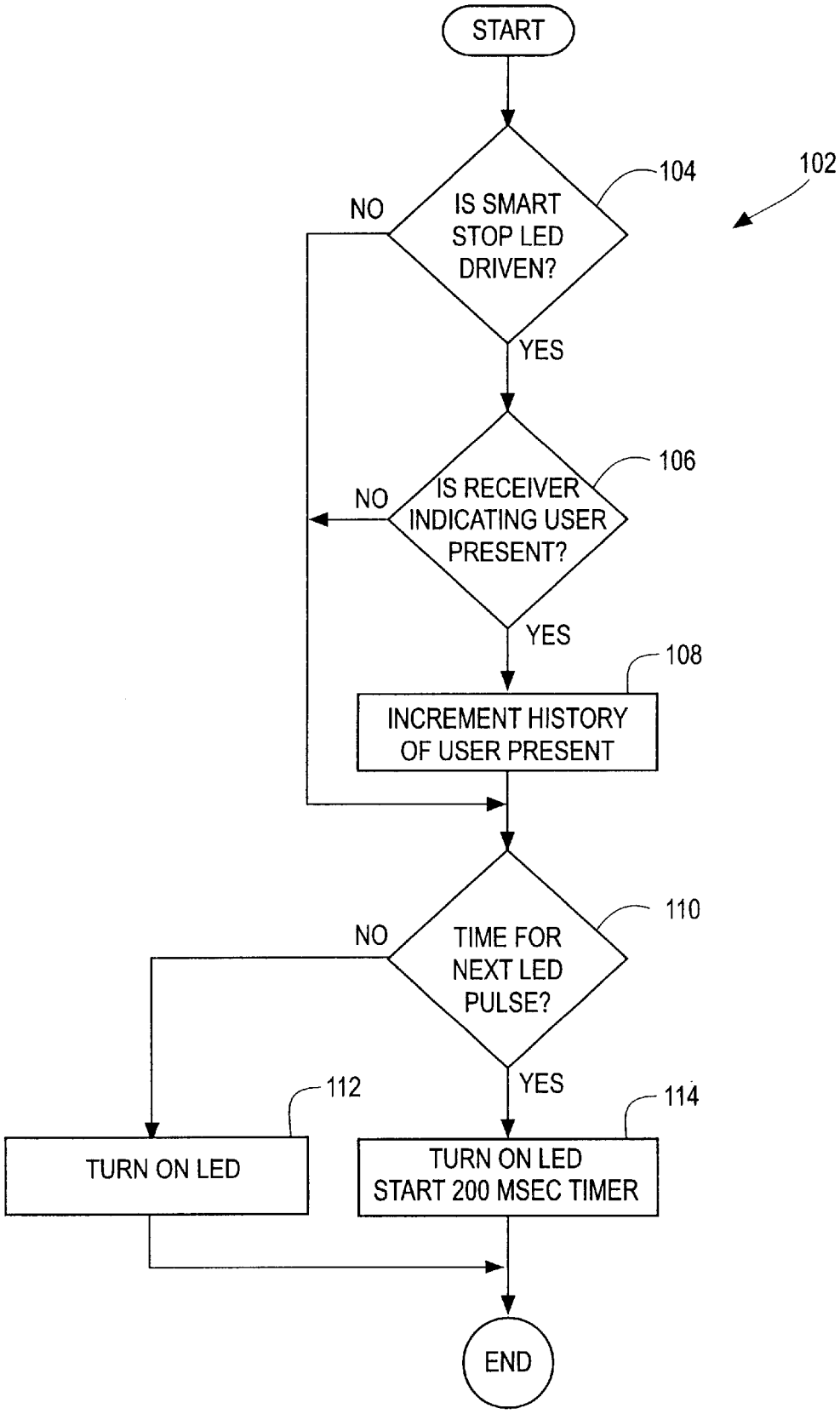
FIGS. 12A–C are flow charts further illustrating the operation of the user detect feature of FIG. 11.
Figure 12B:
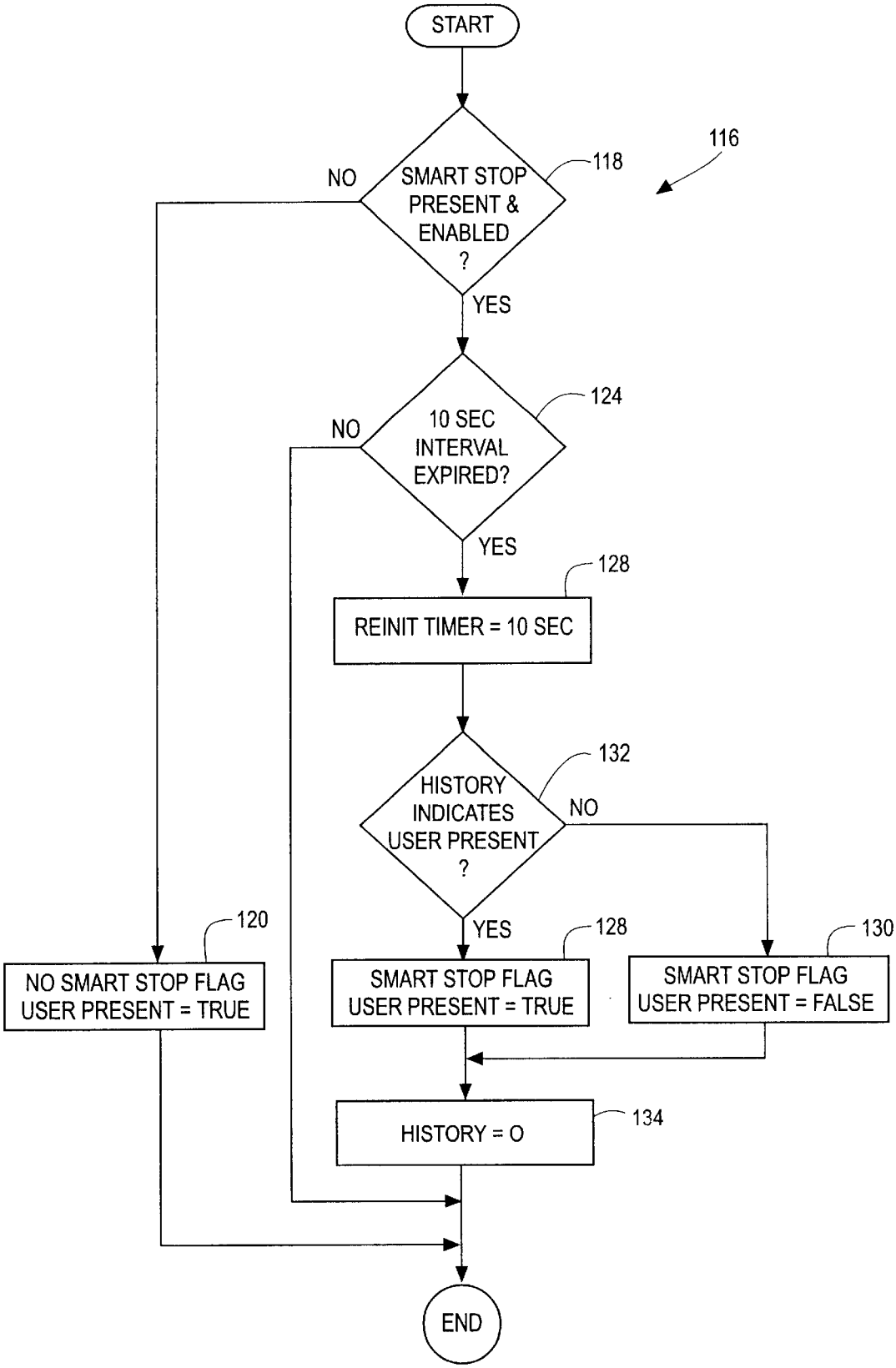
Figure 12C:
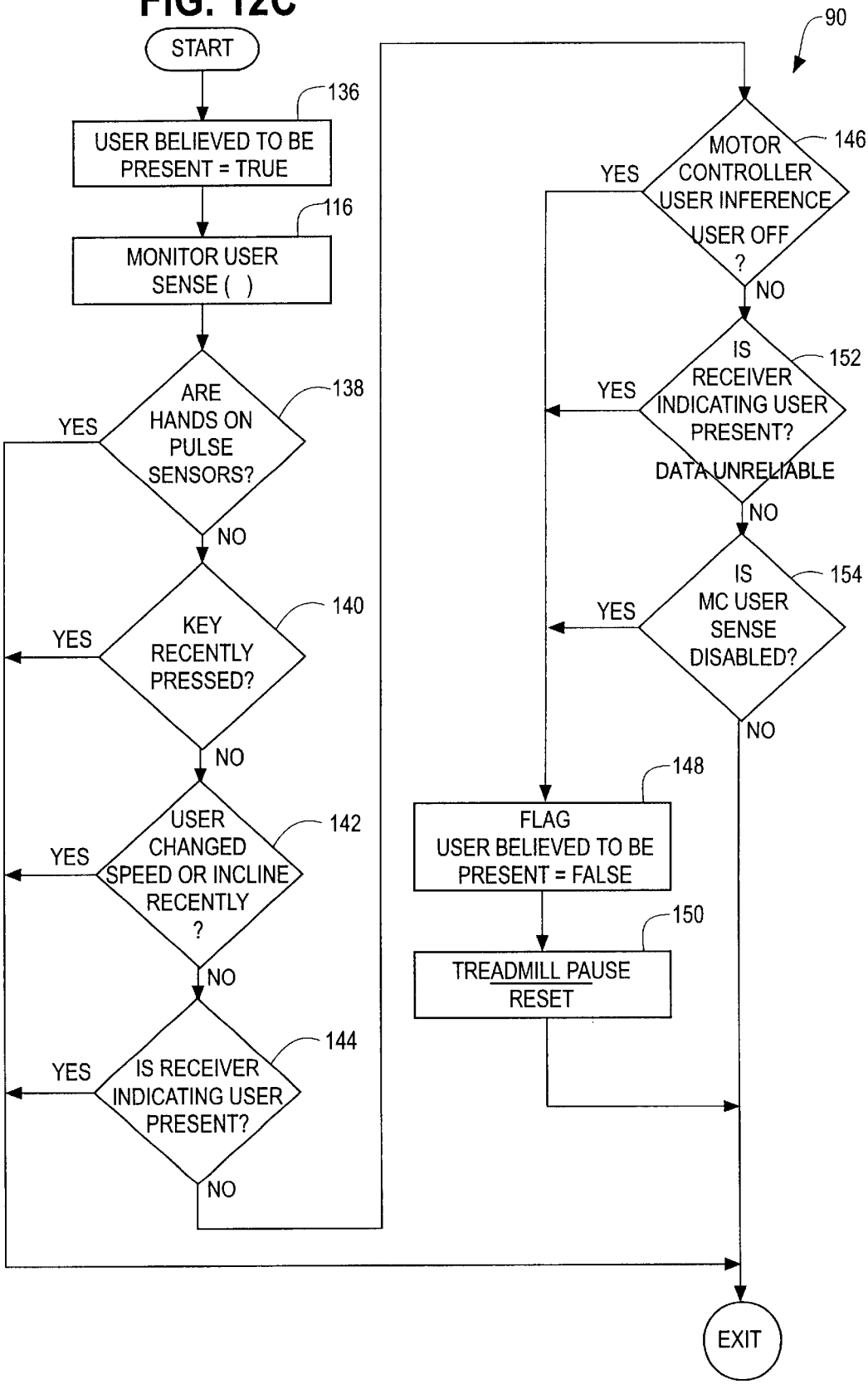

FIG. 11 is a data flow diagram and FIGS. 12A–C are flow charts illustrating the logic applied by the system controller 40 to implement a user detect feature for use with the treadmill 10. In order to overcome the problem of users leaving treadmills before the end of workout programs which can result in treadmills continuing to run for an extended period of time, the treadmill 10 can be provided with a mechanism for stopping the belt 28 that is responsive to various criteria for indicating whether or not the user is on the treadmill 10. Preferably, all of the various resources of information available to the system 34 are used to control this feature. For example, information can be obtained from the motor controller 36 to determine the load on the motor 38 for a predetermined speed which would indicate the presence of a user on the belt 28. This information can also include timing of the use of the key pad 24, the inclination mechanism 32 and use of the pulse sensors 46. In addition, detectors such as an IR detector 72, a weight sensor 74 using a load cell, and a foot pressure sensor 76 can be used to infer the presence of a user on the belt 28. As indicated in FIGS. 11 and 12C, combinations of this type of information in combination with information received from the IR receiver/transmitter 72 can be used to optimize the determination of the presence of a user on the belt 28.

It is also possible to use a detector such as the infrared receiver/transmitter 72 shown in FIGS. 1 and 2 alone as a user detect mechanism. In the preferred embodiment of this detector, a receiver/transmitter 72 transmits an infrared beam which is amplitude modulated at 40 Khz for 500 $\mu$secs every 500 msec. If a user is on the treadmill belt 28, some portion of the light will be reflected back to the receiver/transmitter 72 which is sensitive not only to the frequency of the beam but also to the 40 Khz modulation. This provides the system controller 40 with an indication that the user is on the treadmill belt 28. In this embodiment, when the user leaves the treadmill 10 with the belt 28 still moving and the IR detector 72 does not detect the user, the system controller 40 will cause the treadmill 10 to wait a predetermined time, such as 10 seconds, and then switch to a pause mode. In the pause mode the belt 28 is stopped and a "pause" message is displayed on one of the displays 14. If there is no user input for another predetermined time to the control system 34, such as 1 minute, the pause mode will time out and the system 34 will reset. In this mode the system controller 40 will also cause the treadmill inclination mechanism 32 to return the inclination of the treadmill 10 to a zero. It should be noted that types of active detectors other than the IR detector 72 can be used such as transmitter receiver combinations using sound or radio frequencies.

FIGS. 11 and 12A–C provide a more detailed description of the preferred logic and data flow used in the preferred embodiment of the user detect feature. FIG. 11 is a data flow diagram that represents the flow of data from various sensors such as the pulse sensors 46, the keypad 24, the motor controller 36 and the IR sensor 72 to the system controller 40 in FIG. 1. FIGS. 12A–C illustrate the logic performed by the system controller 40 on this data in implementing the user detect feature. With reference to the diagram of FIG. 11, the pulse sensor 46 and the keyboard 24 are periodically monitored, as shown by at a data circle 78 and a data circle 80 for example every one second as indicated by a dashed line 82 and a dashed line 84 respectively. An indication that the user is operating the treadmill 10 based on the information in the data circles 78 and 80 is transmitted, as illustrated by a line 82 and a line 88, to a data circle 90 representing the user detect logic or "monitor user presence" and is implemented in the system controller 40. This user detect logic as indicated by the monitor user presence circle 90 in FIG. 11 is described in more detail in connection with FIG. 12C and is triggered every one second as indicated by a dashed line 92.

Similarly, the motor controller 36 is monitored as indicated by a data circle 94 at periodic intervals such as every one second as indicated by a dashed line 96. The object of monitoring the motor control is to determine if the load on the motor 36 reflects the presence of a user on the belt 28. For example, if there is a user on the belt 28, it will take more energy to move the belt 28 for a given speed which will be reflected in various parameters of the motor controller 36 as it operates to maintain a predetermined or set speed of the motor 38. In the preferred embodiment, where the motor 38 is an AC motor such parameters as the voltage applied to the motor's armature windings and measurements of motor slip can be used for comparison to a predetermined belt or motor speed either selected by the user or by a workout program being executed by the system controller 40. It will be understood that the parameters used for this load versus speed comparison will depend upon the type of motor and motor controller being used in the treadmill and that for instance in a DC motor, motor current can be used. Also, in the preferred embodiment other criteria is used in connection with the motor control user presence determination 94. For example, as illustrated by the criteria in a box 96, the present incline of the inclination mechanism 32, inclination mechanism history and speed motor history can be used. This criteria provides an indication as to whether there are other factors that might affect the speed vs load relationship other than a user on the belt 28. For example, if the incline of the deck 30 has recently changed or is too high or if the motor speed has recently changed, the speed versus load relationship might not necessarily be representative of a user on the belt 28. As indicated by a data circle 98, the stability of this criterial is used as a check on the reliability of the motor load versus speed information 94. This information, as indicated by a set of lines 100A–C is also used by the motor sense logic 90.

The preferred operation of the IR detector 72 in determining user presence on the belt 28 is illustrated in FIG. 11 and FIG. 12A and FIG. 12B. Overall operation of the IR detector 72 is indicated by a data circle 102 in FIG. 11 and detailed in FIG. 12A. In this embodiment, the read user sense procedure 102 is called every 250 microseconds and as indicated in a set of decision blocks 104 and 106 a determination is made as to whether the IR LED is on and whether the IR receiver detects a user. If a user is detected, the routine 102 increments a user present history counter 107 as shown at a block 108. Then as indicated by a decision block 110 and a set blocks 112 and 114 the IR LED 72A is reset.

Also in the preferred embodiment, at one second intervals, as shown in FIG. 11 and FIG. 12B, a monitor user sense procedure indicated by a data circle 116 is called by the system controller 40 as indicated by a dashed line 117. If as indicated at a decision block 118 the user detect feature indicated by the term "smart stop" in FIG. 12B is not enabled, a flag is set to true at a block 120 indicating to the system controller 40 that there is a user present so that the treadmill 10 will not go into the pause mode. A ten second timer indicated at 122 is used with this procedure. If the smart stop feature is enabled and the ten second interval counted by the timer 122 has expired as indicated by a decision block 124 and the user present history counter 107 shows an absence of a user on the belt 28 as indicated by a decision block 126, the user present flag is set to false at a block 126 otherwise it is set to true at a block 130. This procedure 116 also resets the ten second timer 122 to ten seconds at a block 130 if the ten second interval has expired and as indicated at a block and resets the user present history counter 107 to zero at a block 134. In this manner, the monitor user sense routine 116 is able to determine if the IR detector has not detected a user on the belt 28 for a period of ten seconds.

The preferred of the user detect or monitor user sense logic 90 is illustrated in FIG. 12C. As described above this routine 90 is called every one second by the system controller 40. First, as indicated at a block 136, the user present flag is set to true and then the monitor user sense routine 116 is called. Then, as indicated by a series of decision blocks 138, 140 and 142 the routine 90 checks various treadmill operating parameters including whether hands have been detected on the pulse sensors 46, if the key pad 24 has been used recently and if the user has changed the incline mechanism 32 or speed recently based on information shown in the box 96 of FIG. 11. In addition the user sense 116 is checked to determine if a user has been detected on the belt 28. If the answers to any of these questions is yes, the routine 90 exits. If the answer is no, then the routine 90 checks the motor controller presence likelihood or inference data 98 at a decision box 146 and if it appears that the user is not on the belt 28, the routine 90 sets the user present flag true at a box and then proceeds to a treadmill pause and reset routine indicated by a box 150 and a dashed line in FIG. 11. In the preferred embodiment as discussed above, the treadmill 10 will enter the pause mode for one minute and then if there is no further user activity, the system controller 40 will reset the treadmill 10. However, if the motor controller presence inference data 98 at a decision box 146 can not make an inference that the user has left the belt 28, the routine 90 then first checks at a decision box 152 to determine if the data 98 is too unreliable to use this data by, for example, checking the information in the box 96. If the information 96 suggests that the motor controller data is too unreliable, the routine 90 then branches to the pause and reset routine 150. Otherwise, the routine 90 then checks at a decision box 154 to determine if the the motor controller presence inference routine 98 has been disabled and if it has then branches to the pause and reset routine 150.

Another feature of the treadmill 10 is a frame tag module 77 as shown in FIG. 2 which is preferably secured to one of the side frames of the treadmill 10 and is adapted to communicate with the system controller 40. In the preferred embodiment, the frame tag module 77 includes a nonvolatile electrically erasable programmable memory chip (EEPROM) 79 and a real time clock 81. Included with the EEPROM 79 is a 10 year battery (not shown). Preferably, the clock 81 will be initialized to GMT at the time of manufacture of the treadmill 10 and then set to local time when the treadmill 10 is installed at a customer location and each entry into the EEPROM 79 will be date stamped by the clock 81. In normal operation, each time the treadmill 10 is powered up, the system controller 40 will retrieve treadmill configuration information from the frame tag module 77. Included in this information can be such data items as English or metric units for display on the displays 14, maximum and minimum treadmill belt speeds, language selection as well as accumulated treadmill operational data such as the total time, the total miles, the belt time, the belt miles and the number of program selections. Preferably, when the treadmill 10 is in operation, the system controller 40 will cause data relating to each user workout and operation of the treadmill 10 to be stored in the EEPROM 79 along with all information relating to system errors that might occur. In addition, all information relating to any service procedure is stored in the EEPROM 79. This information stored in the EEPROM 79 including set up, operational and service data can be displayed on the displays 14 by the system controller 40 so that the history of the treadmill 10 can be read by service personnel. One of the advantages of the frame tag module 77 is if any of the major electrical or mechanical components of the treadmill 10 is replaced, the operational history of the treadmill 10 is not lost. For example, if the control panel 12 containing the system controller 40, is replaced the treadmill's history will not be lost. The frame tag module 77 can also be replaced without losing the machine's history. In this case, because when the treadmill 10 is powered up, this information is transmitted from the old frame tag module 77 to the system controller 40, this information can then be transmitted back to the new frame tag module 77 after it has been installed on the treadmill 10 thereby maintaining the treadmill's history with the treadmill 10.

FIG. 13 is a flow chart illustrating the preferred operation of a time in heart rate zone routine 156 implemented in the system controller 40 of the treadmill 10. In this feature, the user's heart rate is continuously monitored by the heart rate monitoring system using the pulse sensors 46 while in a preprogramed heart rate workout such as fat burn or cardio workout to provide the user a display on one of the displays 14 of an indication of the time in a predetermined heart rate zone. The user's heart rate zone is determined by comparing the user's actual heart rate with that of the target heart rate as entered by the user on the key pad 24 or calculated for the user by the heart rate management system. After the routine 156 establishes that the workout program is a heart rate workout as indicated at a decision block 158, the routine 156 then determines at a decision box 160 whether the user has entered his own target heart rate using the key pad 24. If the user has input his desired target hearts rate, the appropriate heart rate zone is calculated as indicated by a box 162. In this example, the zone is preferably + or −10 beats from the target heart rate. In the event that the user has not entered his target heart rate, a decision block 164 indicates that the routine 156 determines if the programed workout is a Cardio workout or a fat burn workout and the desired heart rate zone is calculated as indicated by a block 166 or a block 168. For the fat burn workout, the target is preferably between 60 and 72 percent of the calculated maximal heart rate of (220-age). For Cardio workout, the target is preferably between 72 and 85 percent of the calculated maximal heart rate of (220-Age). After the appropriate heart rate zone has been calculated the routine 156 clears a time in zone clock as shown at a block 170.

As shown in FIG. 13, if the user is in the heart rate zone as determined by a decision block 172 the time in zone clock is incremented and a heart rate in zone flag is set to true as shown by a block 174, each second is accumulated and can be displayed on one of the displays 14 or a dedicated TIME-IN-ZONE display (not shown.) If the user is in the heart rate zone and has attained his target heart rate previously as indicated by a decision block 176 and then an entry message such as "ENTERING TARGET HEART RATE ZONE" can be displayed on the displays 14 or the dedicated display as shown by a block 178. It is preferred that visual feedback, via a live heart rate zone chart on the displays 14 be used to graphically show the user his heart rate relative to the heart rate zone. On the other hand, if the user's heart rate was in the zone, but then changes so as to no longer be in the zone as determined at a decision block 180, an exit message such as "LEAVING TARGET HEART RATE ZONE" is displayed on the displays 14 or the dedicated display as shown at a block 182 and the heart rate in zone flag is set to be false as indicated by a block 184. In the preferred embodiment, heart rate programs implemented in the system controller 40 with time in zone as the goal can be selected by the user with one of the workout control buttons 16. Additionally, at the conclusion of a workout, a percentage of the workout time in the heart rate zone can be displayed on one of the displays 14. This information can also be stored, either in the control system 34 or the frame tag 76 or via a network connection, to provide tracking information so the users can ascertain progress in their workout routines. This information is useful to determine the overall efficiency of the workout time, as it is believed that the most efficient calorie burn may occur while in the heart rate zone. It is also possible to provide real-time recommendations to the user as to how to improve his time in zone efficiency by, for example, instructing the user via the displays 14 to adjust speed, incline, resistance, etc. In addition, it is possible to allow the exercise equipment such as the treadmill 10, possibly with user acceptance, to automatically perform these adjustments to create a TIME-IN-ZONE MANAGEMENT workout. Although the above system has been described in the embodiment of the treadmill 10, this feature can equally be used in other types of aerobic type exercise equipment having heart rate management systems such as exercise bikes, step machines and elliptical steppers. Also, the above system can use types of heart rate monitors other than the pulse sensor or heart rate monitor system 46 described above such as monitors that transmit a pulse signal from a pulse sensor belted to a user to a receiver on the exercise apparatus.

It should be noted that the various features described above have been described in terms of their preferred embodiments in the context of the particular treadmill 10 and control system 34 disclosed herein. The manner in which these features can be implemented will depend upon a number of factors including the nature of the treadmill and control system. With respect to programing, there are many different types of hardware and programing languages and techniques that would be suitable for implementing these features that would fall within the scope of this invention.

We claim:

1. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor and said inclination mechanism;

a control panel secured to said frame structure and operatively connected to said control system wherein said control panel includes at least one display and a set of user controls for controlling the treadmill including said belt speed and said inclination mechanism, to permit a user to operate the treadmill for a workout; and a stop program operatively associated with said control system for stopping the movement of said belt when no user is detected on said belt for a first predetermined amount of time wherein said stop program uses information representing treadmill operating criteria from said control system to detect the user on said belt.

2. The exercise treadmill of claim 1 wherein said operating criteria includes operation of said user controls.

3. The exercise treadmill of claim 1 wherein said operating criteria includes operation of said motor.

4. The exercise treadmill of claim 1 wherein the treadmill includes pulse sensors and wherein said operating criteria includes operation of said pulse sensors.

5. The exercise treadmill of claim 1 wherein said operating criteria includes operation of said inclination mechanism.

6. The exercise treadmill of claim 1 additionally including a detector operatively connected to said control system for detecting the presence of a user on said belt and said stop program utilizes said operating criteria to provide an indication of the absence of the user on said belt in combination with said detector to stop the movement of said belt.

7. The exercise treadmill of claim 1 wherein said first predetermined time is approximately 10 seconds.

8. The exercise treadmill of claim 1 wherein said stop program places the treadmill in a pause mode after said first predetermined time and then resets the treadmill after a second predetermined amount of time.

9. An exercise treadmill, comprising:

a frame structure including two rotatable pulleys, said pulleys being positioned substantially parallel to each other, and a pair of spaced apart longitudinal frame members for providing longitudinal structural support for said frame structure;

a motor for rotating a first one of said pulleys;

a belt secured over said pulleys so as to move in a longitudinal direction when said first pulley is rotated;

an inclination mechanism secured to a first end of said frame structure effective to permit selective inclination of said frame structure by a user;

a control system operatively connected to said motor and said inclination mechanism;

a control panel secured to said frame structure and operatively connected to said control system wherein said control panel includes at least one display and a set of user controls for controlling the treadmill including said belt speed and said inclination mechanism, to permit a user to operate the treadmill for a workout;

a detector operatively connected to said control system for detecting the presence of a user on said belt; and a user detect program operatively associated with said control system and responsive to one or more treadmill operating criteria received from said control system for stopping the movement of said belt when said operating criteria indicates no user is detected on said belt for a first predetermined amount of time.

10. The exercise treadmill of claim 9 wherein said operating criteria is selected from the group consisting of use of said user controls, speed of said belt, operation of said inclination mechanism, operation of said motor and operation of a pulse sensor.

* * * * *